US006520190B2

(12) United States Patent
Thompson et al.

(10) Patent No.: US 6,520,190 B2
(45) Date of Patent: Feb. 18, 2003

(54) SPRAYER WITH REVERSE FLUSH CAPABILITY

(75) Inventors: David J. Thompson, Oak Grove, MN (US); Diane L. Olson, Princeton, MN (US); Steven E. Durkee, Ramsey, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 115 days.

(21) Appl. No.: 09/785,365

(22) Filed: Feb. 16, 2001

(65) Prior Publication Data

US 2001/0045471 A1 Nov. 29, 2001

Related U.S. Application Data

(63) Continuation-in-part of application No. PCT/US00/06316, filed on Mar. 9, 2000.
(60) Provisional application No. 60/123,630, filed on Mar. 10, 1999.

(51) Int. Cl.[7] ..... B08B 9/093

(52) U.S. Cl. ..... 134/22.18; 134/22.1; 134/22.11; 134/22.12; 134/34; 134/38; 134/42; 134/169 C; 134/169 R; 118/302; 239/112

(58) Field of Search ..... 134/22.12, 22.18, 134/34, 38, 42, 169 C, 169 R, 22.1, 22.11; 118/302; 239/112

(56) References Cited

U.S. PATENT DOCUMENTS

| | | | | |
|---|---|---|---|---|
| 4,676,435 A | * | 6/1987 | Nesland | 137/625.48 |
| 5,401,324 A | * | 3/1995 | Huddas | 134/21 |
| 6,037,010 A | * | 3/2000 | Kahmann et al. | 118/302 |

* cited by examiner

*Primary Examiner*—Randy Gulakowski
*Assistant Examiner*—M. Kornakov
(74) *Attorney, Agent, or Firm*—Douglas B. Farrow

(57) ABSTRACT

A system for flushing an airless sprayer essentially reverses operation such that the spray gun is immersed in a container of water or other solvent and that fluid is pulled through the pump and flushed through the normal inlet tube. The preferred embodiment attaches a fluid bar to the front of the spray gun to redirect the fluid for flushing. This reverse flushing action allows quicker flushing using less fluid.

9 Claims, 12 Drawing Sheets

SPRAYER WITH REVERSE FLUSH CAPABILITY

This application is a continuation-in-part of PCT serial number PCT/US00/06316, filed Mar. 9, 2000 which is in turn a continuation-in-part of U.S. Application serial No. 60/123,630, filed Mar. 10, 1999.

TECHNICAL FIELD

1. Background Art

Airless and other paint sprayers have been widely used for commercial and other painting purposes for many years. One of the least liked aspects of such units however is the need for cleaning at the end of a day or job. Typically, such cleaning consists of immersing the intake tube of the unit in a bucket of water or other solvent and flushing into a bucket until the fluid coming out of the gun is clean and clear. The amount required can often be many gallons. Removal of the filter in the system is also necessary to remove debris trapped on the inlet side of the filter.

2. Disclosure of the Invention

It is therefore an object of this invention to provide an enhanced method of flushing and airless sprayer which is easily accomplished with minimal operator input and which flushes more thoroughly than traditional methods while using less fluid.

Fluid from the pump outlet is rerouted away from the manifold filter and into the front of the spray gun enabling cleaning fluid to be pumped in reverse through the gun, the hose, the filter manifold and out the drain valve into a waste bucket to collect the flushed material. The reverse flow clears the debris caught in the filters during spraying.

In an alternate embodiment, for flushing the tip of the airless spray gun is removed, the trigger opened and the gun placed in a container of water or other suitable solvent depending on the material to be flushed. A dump valve control is then operated which connects the gun line to the pump intake and the pump output is connected to the return line which is in turn connected to the suction tube placed in a container to collect the flushed material. The pump is then operated and generates reverse flow in the system: (1) until the operator sees the output to be clean; or (2) for a predetermined period of time while the operator does other things; or (3) until an opacity detector finds the output to be clear; or (4) until a pressure sensor sees a pressure drop reflecting exhaustion of the cleaning fluid.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
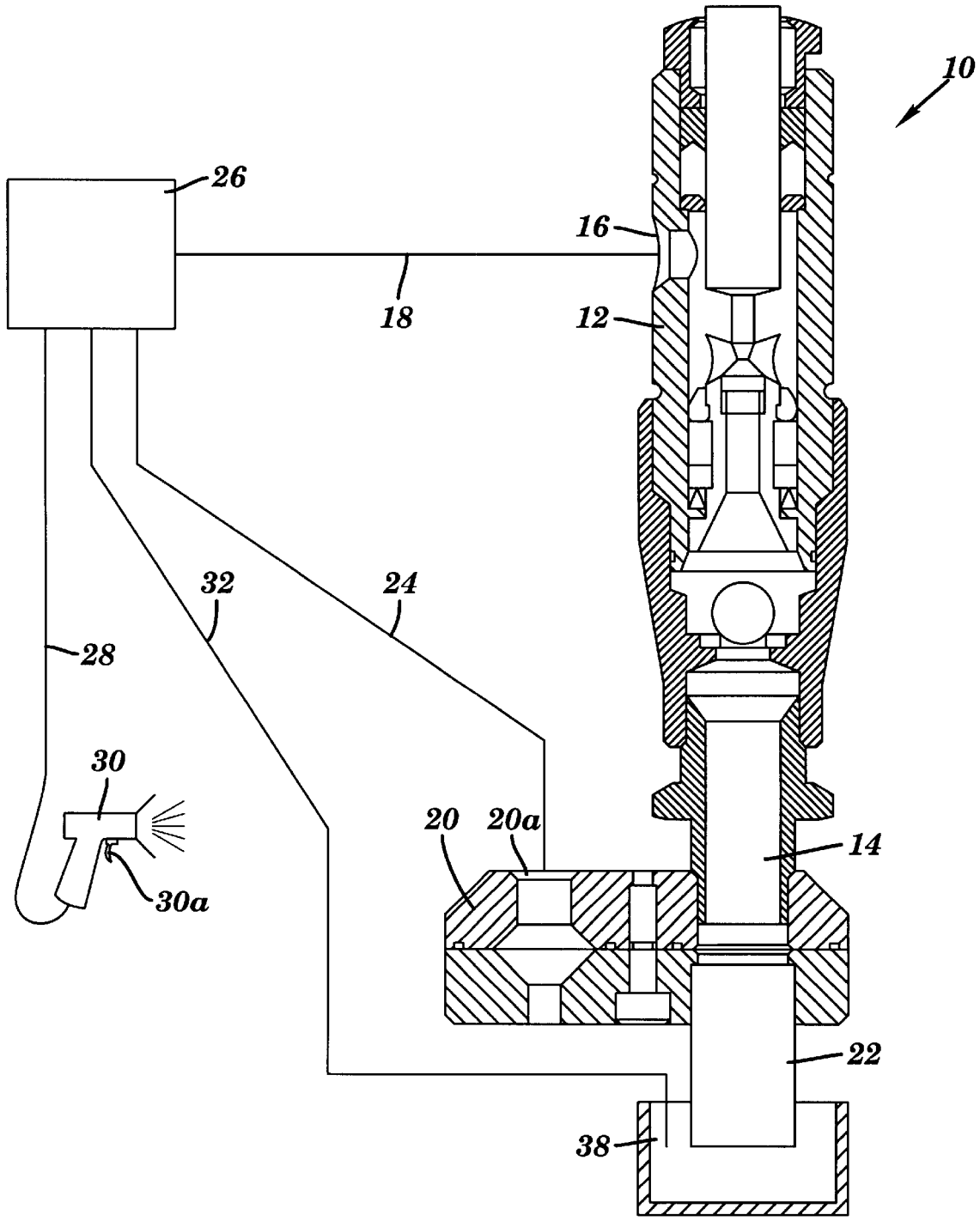
FIG. 1 is a schematic view of the instant invention in the standard spray configuration.
Figure 2:
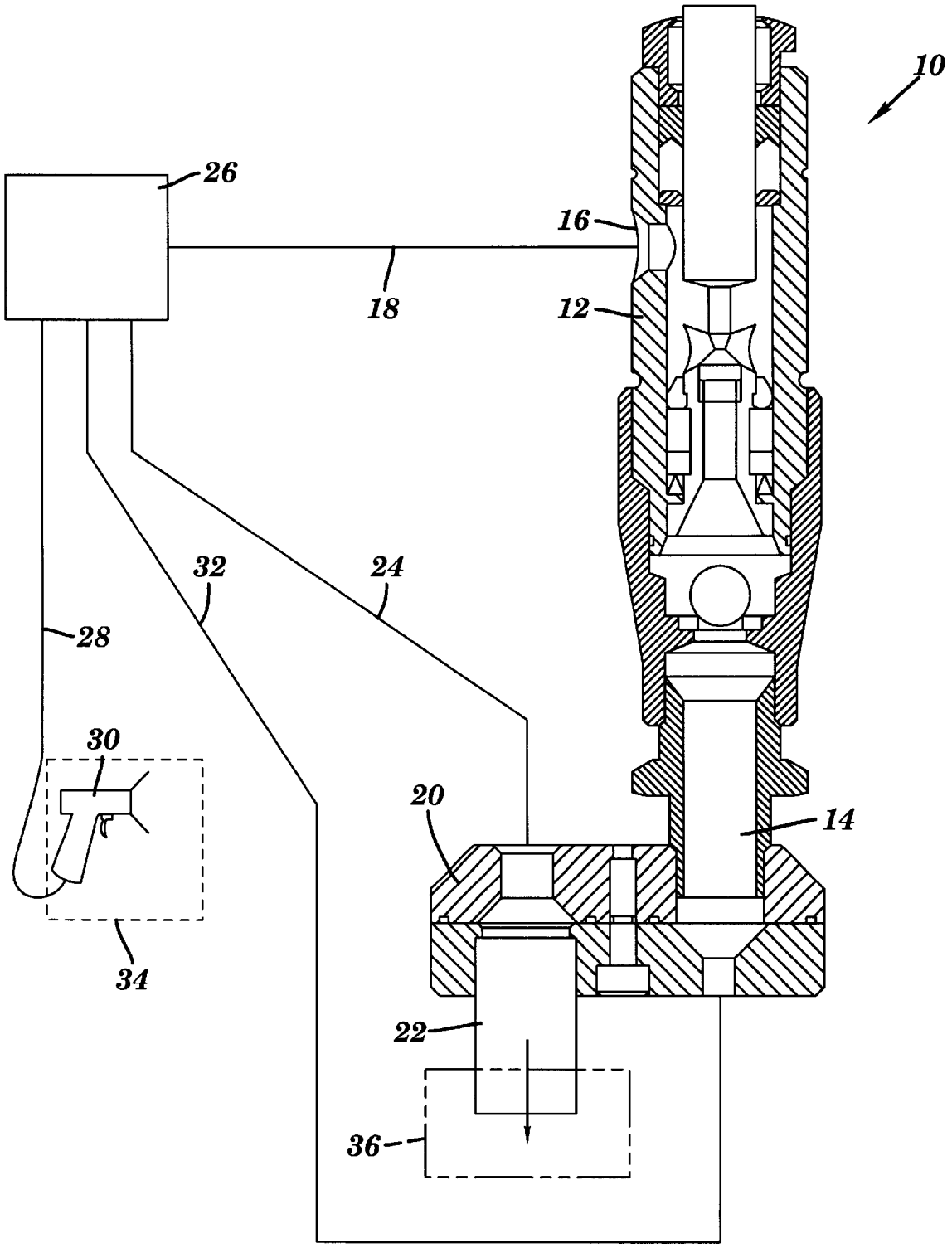
FIG. 2 is a schematic view of the instant invention in the flush configuration.

The sprayer, generally designated 10 is shown in FIGS. 1 and 2 and is comprised of a pump 12 having intake 14 and outlet 16. Outlet line 18 is connected to outlet 16 and dump valve control 26. Gun line 28 connects control 26 to spray gun 30 having trigger 30*a*. Dump line 32 connects control 26 to material container 38 while return line 24 connects control 26 to inlet switch valve 20 at port 20*a*.

In the spraying configuration shown in FIG. 1, the suction tube 22 is connected via inlet switch valve 20 to pump inlet 14. Pump outlet 16 sends coating to be sprayed to control 26 via line 18 where it is connected to line 28 and gun 30 (it may also be connected to line 32 for priming).

In the flushing configuration shown in FIG. 2, gun 30 is immersed in cleaning media 34 and line 28 connected to line 32 at control 26. Line 32 is then connected to pump inlet 14 at inlet switch valve 20. Pump outlet 16 sends the flushing material to control 26 via line 18 where it is connected to return line 24 and thence to intake tube 22 in waste bucket 36 via inlet switch valve 20.

After a painter has completed a paint color or job they will be required to get the cleaning media such as water. It will require approx. 5 gals with a small airless sprayer. They should "chase" the painting media with the clean media until they have removed as much of the salvageable material as desired.

At this time the user should place the gun 30 with the trigger 30*a* locked in the open position and the tip removed into the cleaning media 34. Operate the dump valve control 26 to the clean position. Turn the inlet switch valve 20 by 180 degrees to reverse the intake to the gun line 28. Put the pump suction line 22 into an empty bucket 36. Go to the control and switch the sprayer to the "clean" position. The pump 12 will take approx. 2 min to prime and then the sprayer will reverse flush for about 7–9 minutes. When the sprayer shuts down the user can wipe down the stinger or suction tube 22 and empty the waste bucket 36. Wipe down the gun and attach it to the sprayer and the clean up is completed.

Figure 3:
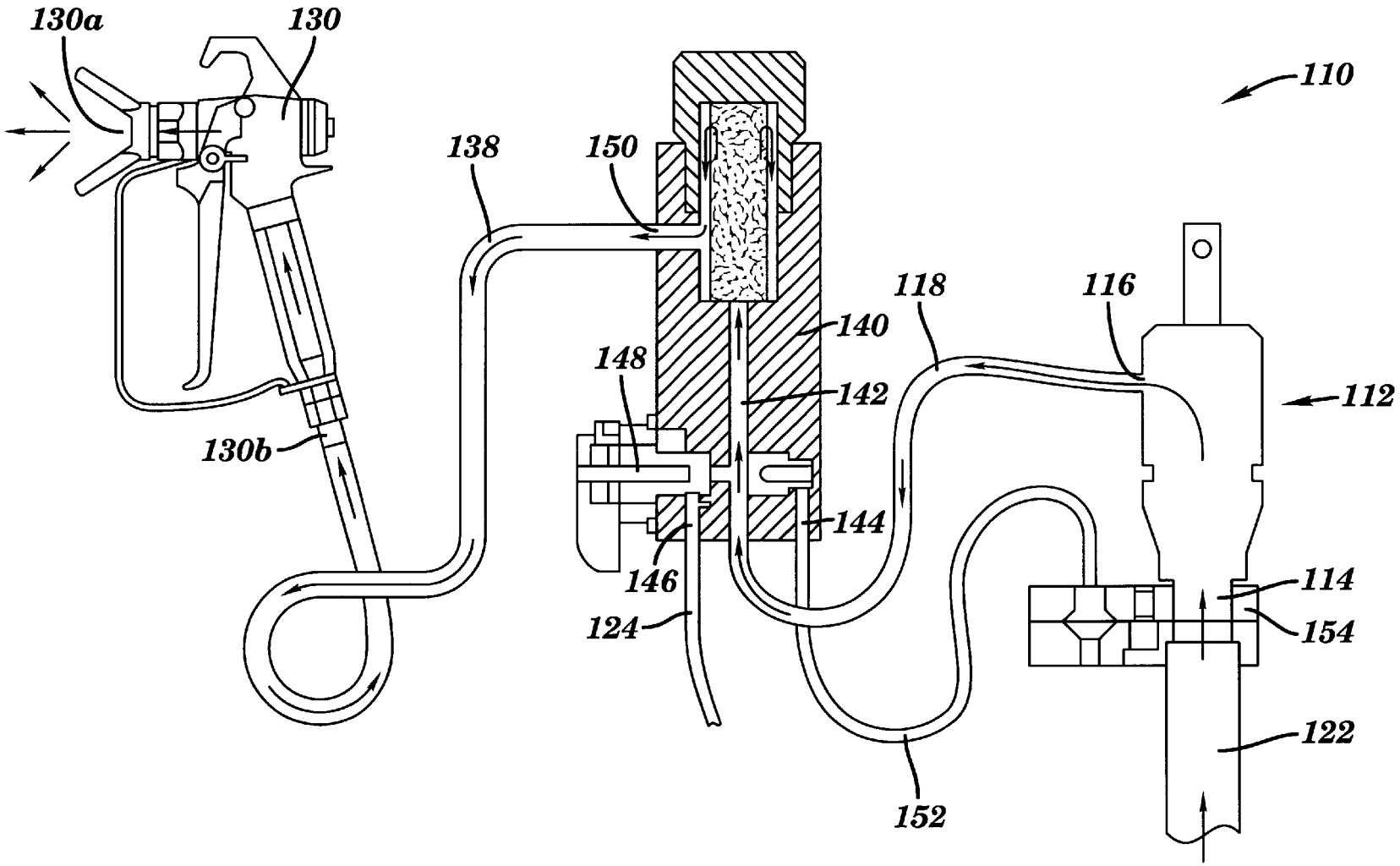
FIG. 3 is a schematic view of an alternate embodiment of the instant invention in the standard spray configuration.
Figure 4:
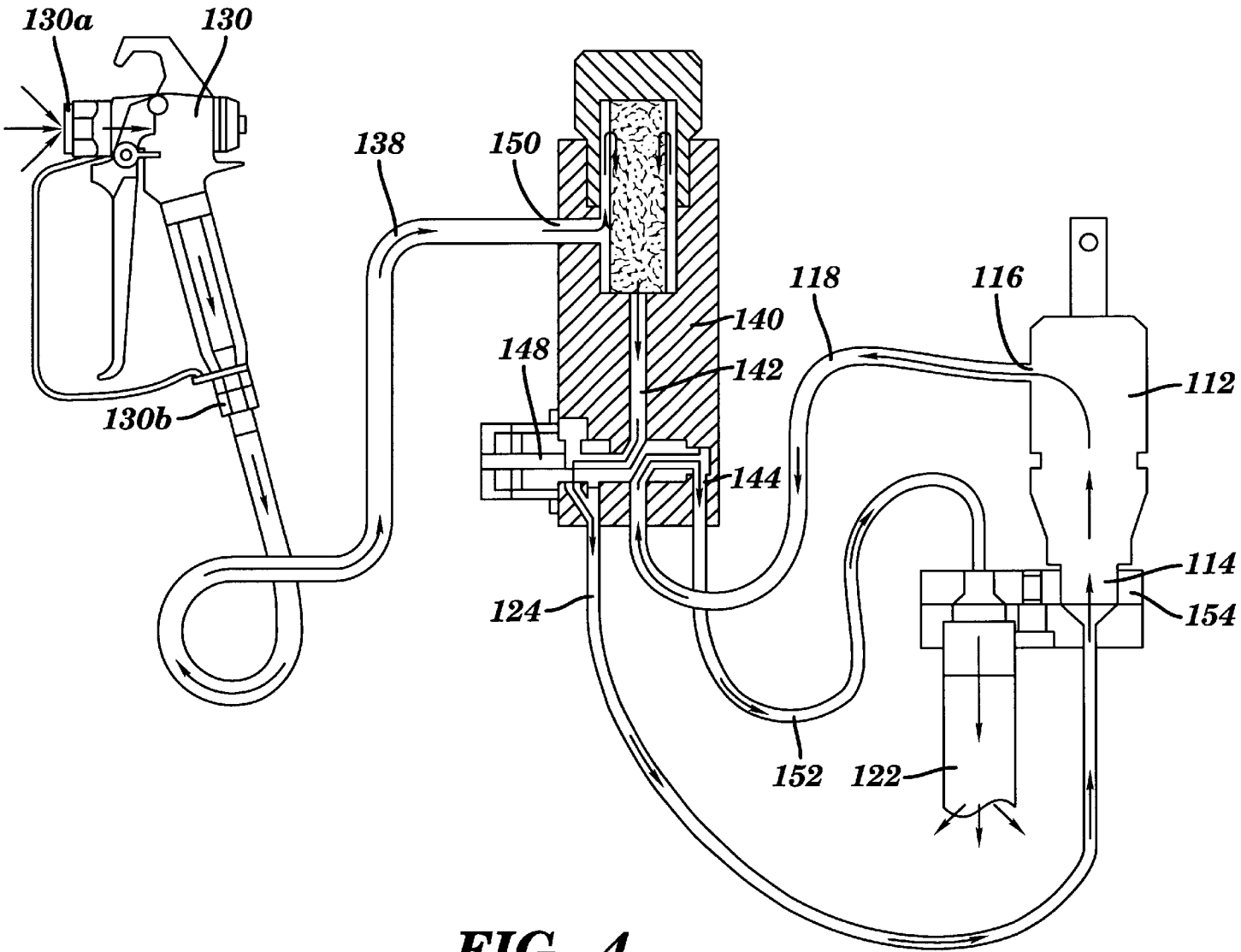
FIG. 4 is a schematic view of an alternate embodiment of the instant invention in the flush configuration.

FIGS. 3 and 4 show another embodiment 110 of the instant invention. A pump 112 has an inlet 114 and an outlet 116. Outlet 166 is connected via line 118 to the inlet 142 of filter 140. Return port 144 of filter 140 is connected to switch valve 154 via line 152. Control valve 148 also can connect inlet 142 to dump line 124. Spray gun 130 is connected to filter 140 via line 138 at inlet 130*b*. Gun 130 sprays at outlet 130*a*.

The operation of embodiment 110 for normal spraying is shown in FIG. 3. Switch valve 154 is positioned in the first position shown in FIG. 3 such that paint or other material to be sprayed is drawn in through intake tube 122 and thence into pump inlet 114. The fluid is then pumped from outlet 116 through line 118 to filter inlet 142 and then from outlet 150 via line 138 to gun 130 where it is sprayed.

For cleaning and flushing, control valve 148 and switch valve 154 are positioned as shown in FIG. 4. Spray gun 130 is placed in a container of cleaning fluid (water for water based materials or a solvent for solvent based materials) which fluid is drawn into the gun inlet 130*a*. The fluid is then drawn through line 138 into filter outlet 150 where it reverse flushes filter 140 passing through control valve 148 into dump line 124 where switch valve 154 connects it to pump inlet 114. Pump 112 then pumps the fluid from pump outlet 116 through line 118 to control valve 148 where it is directed to port 144 and line 152 which is connected to intake tube 122 at switch valve 154 and outputted into a bucket or other collector.

Figure 5:
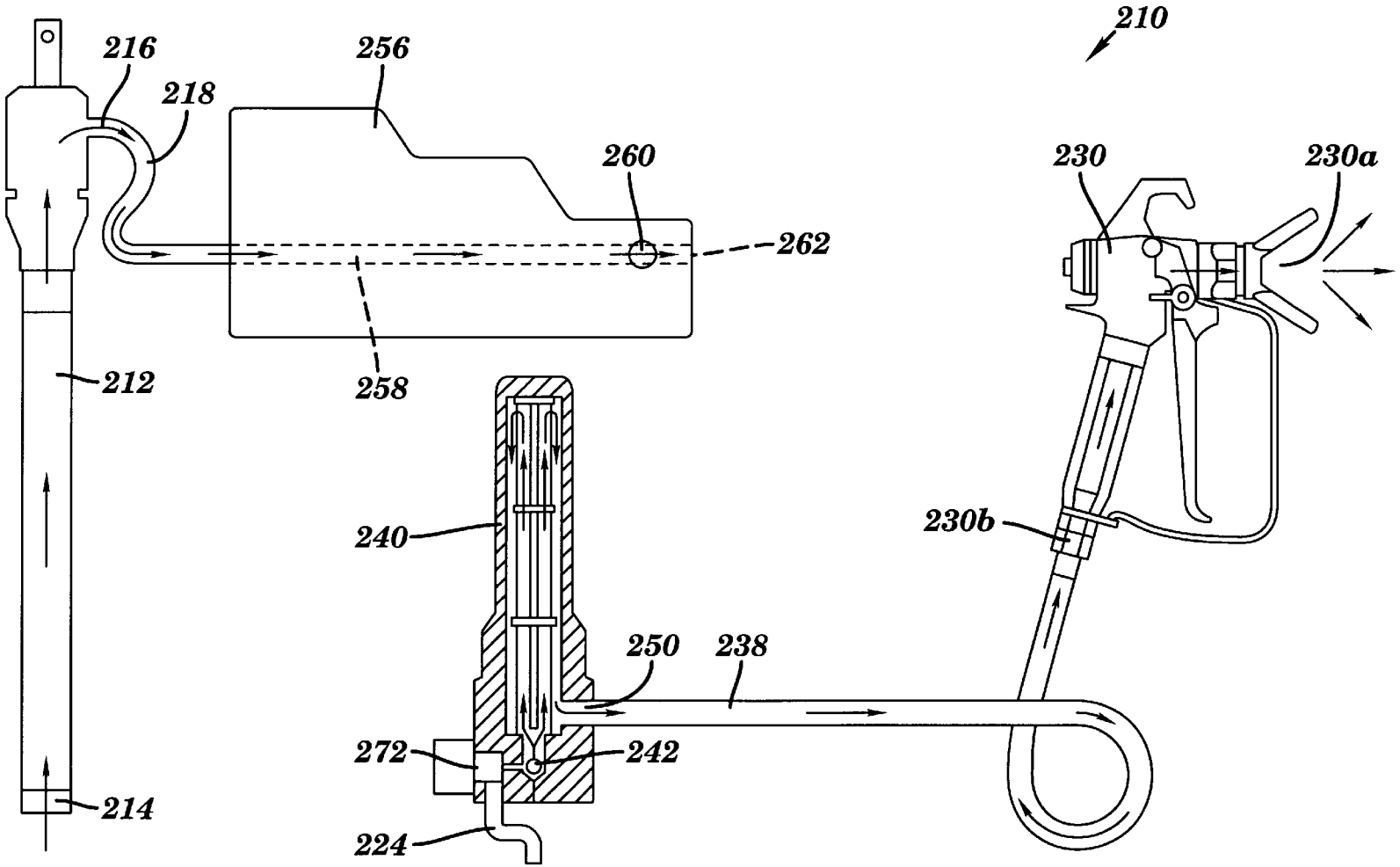
FIG. 5 is a schematic view of an alternate embodiment of the instant invention in the standard spray configuration.
Figure 6:
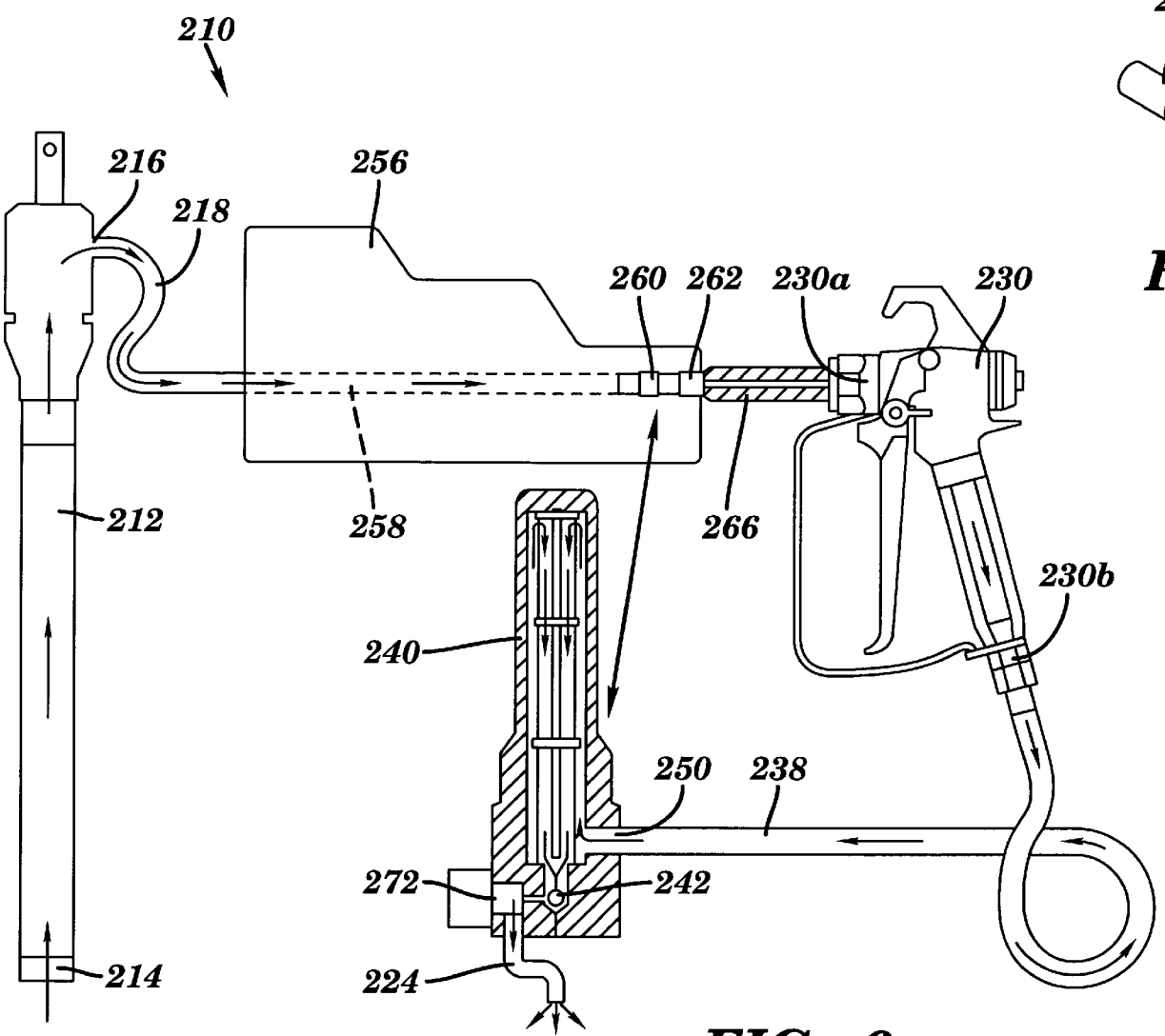
FIG. 6 is a schematic view of an alternate embodiment of the instant invention in the flush configuration.
Figure 8:
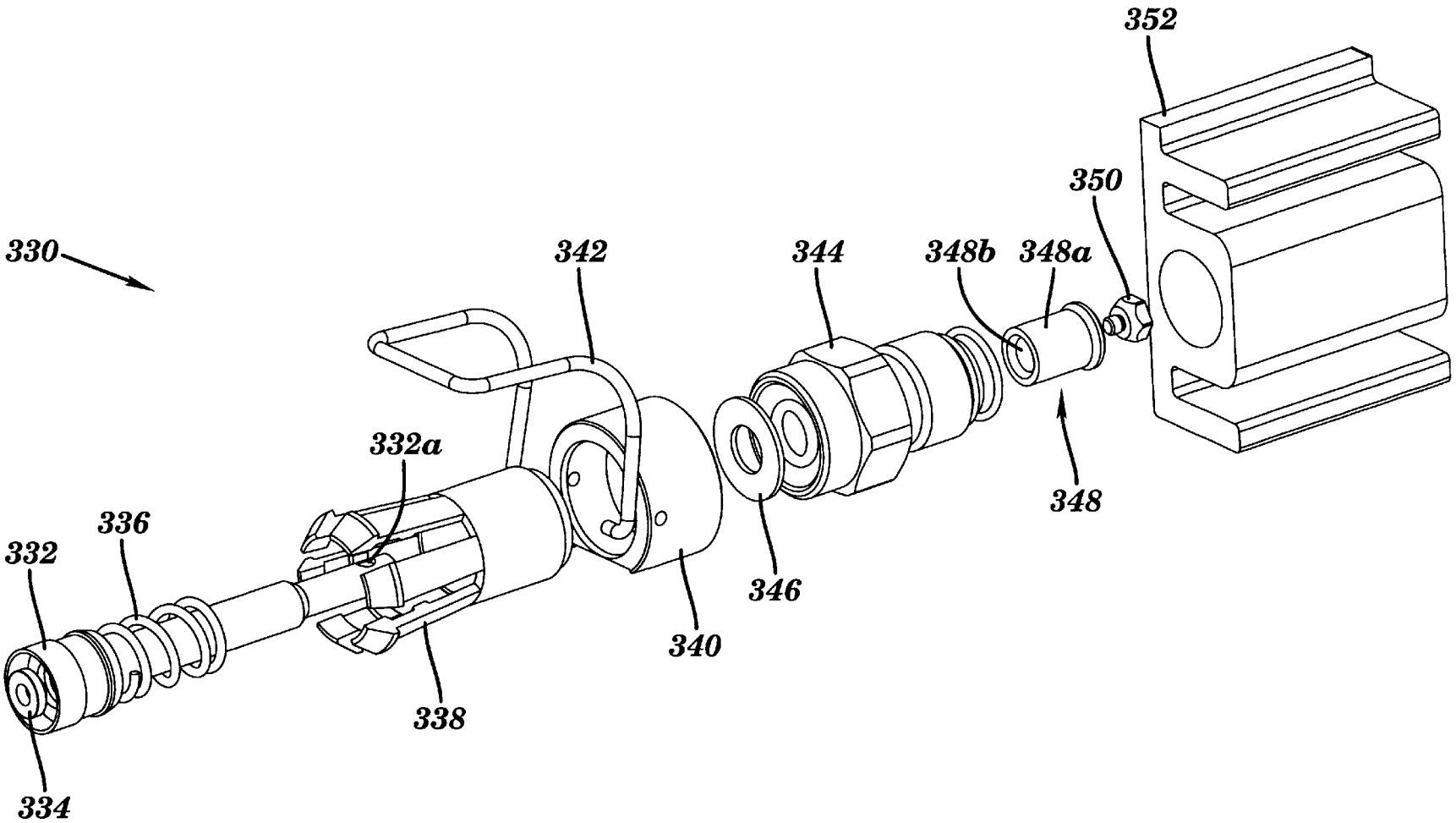
FIG. 8 is an exploded view of the reverse flush valve of the preferred embodiment.
Figure 9B:
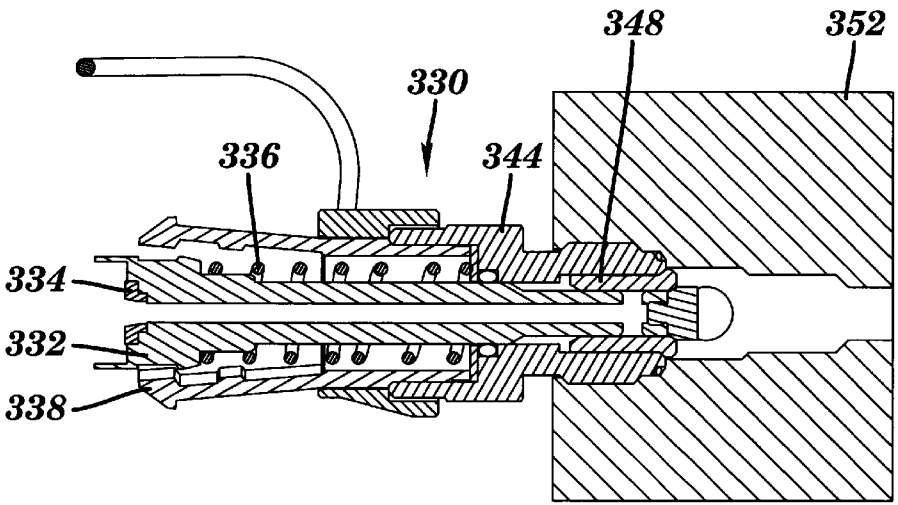
FIG. 9*b* is a cross-sectional view of the reverse flush valve of the preferred embodiment in the spray position.
Figure 9A:
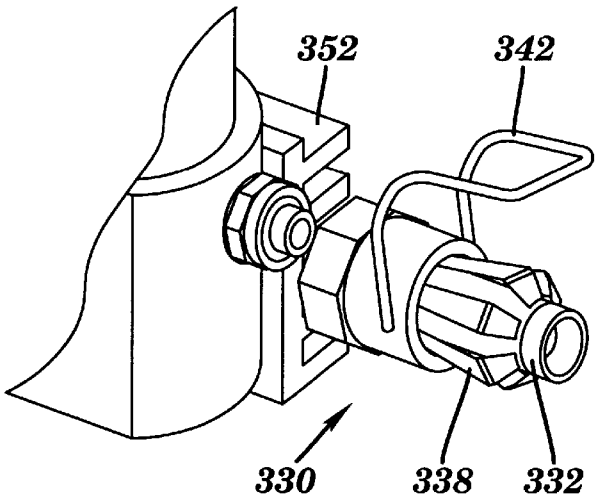
FIG. 9*a* is a view of the reverse flush valve of the preferred embodiment in the spray position.

In the embodiment 210 shown in FIGS. 5 and 6, pump 212 has an inlet 214 and an outlet 216 which is in turn connected via line 218 to fluid bar 256. Fluid bar 256 has a central passage 258, a filter port 260 and an outlet 262. Filter 240 has an inlet 242 which is connected to filter port 260. Filter 240 also has a drain valve 272 connected to a dump line 224. Filter outlet 250 is connected to spray gun 230 inlet 230*b* via line 238.

For spraying, the sprayer is configured as shown in FIG. 5 such that paint or other material is pumped from pump inlet 214 to line 218 and thence into fluid bar 256 which has outlet 262 plugged. The material passes through filter port 260 into filter 240 and thence through line 238 to spray gun 230 where it is sprayed from outlet 230*a*.

Figure 7:
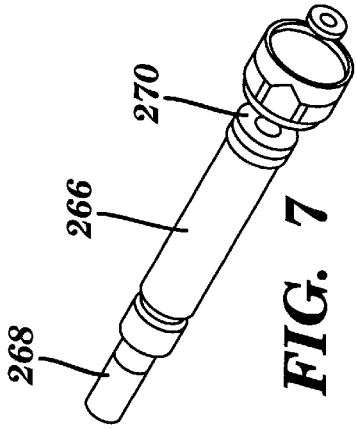
FIG. 7 is a partially exploded view of the fluid stem.

For cleaning and flushing, the sprayer 210 is configured as shown in FIGS. 6 and 7. The operator should "chase" the painting media with the clean media until they have removed as much of the salvageable material as desired. Fluid stem 266 has an inlet portion 268 which is inserted into port 262 of fluid bar 256 where it blocks filter port 260. Gun attachment nut 270 allows the other end of stem 266 to be attached to outlet 230*a* of spray gun 230. In order to do so, the gun tip and guard must be removed and the trigger locked into the on position. In operation, fluid is pumped through pump 212 into fluid bar 256 where it is passed to stem 266 and thence flows in reverse direction through spray gun 230, line 238 and filter 240 where drain valve 272 is operated so that the cleaning fluid is exhausted from line 224. A final step to complete the cleaning process is for the operator to wipe the outside of the intake tube and examine the filters to make sure they have been completely cleaned.

The preferred embodiment is shown in FIGS. 8–13. The reverse flush valve 330 is comprised of a stem 332 having a gasket 334 and a spring 336 thereon. Further parts include a collet 338, a collar 340 with a retaining clip 342, a valve housing 344 with an o-ring retainer washer 346, a sleeve 348 and a poppet 350 along with a fluid bar 352. The reverse flush valve 330 accomplishes several tasks: it (1) actuates flow on and off between the fluid bar 352 and the filter manifold 354; (2) actuates flow on and off out of the valve's stem 332; (3) locks the valve 330 in spray position to avoid unintentional actuation; (4) physically connect the gun 328 to the valve 330 by means of the collet 338; and (5) locks the gun's trigger 328*a* open in the clean position.

In the spray mode (see FIGS. 9*a*, 9*b* and 12), fluid is routed into the filter manifold 326. The valve 330 components seal against themselves with the tension of spring 336. The sleeve 348 seals against the valve housing 344 on its outer diameter 348*a* and the poppet 350 seals on the sleeve's inner diameter 348*b*. The valve 330 is designed so that its sealing method benefits from increased system pressure—as pressure increases, the sealing surfaces are pressed more firmly together. Since the sleeve seals in multiple locations, it is constructed of a soft material to ensure reliable and repeatable sealing. As the sleeve wears, the spring takes up slack and the valve continues to seal.

Figure 10B:
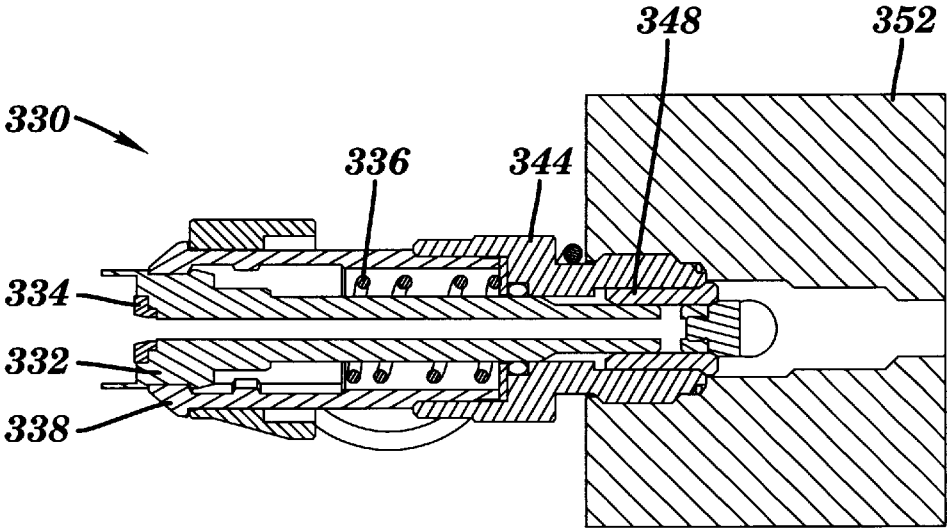
FIG. 10*b* is a cross-sectional view of the reverse flush valve of the preferred embodiment in the locked spray position.
Figure 10A:
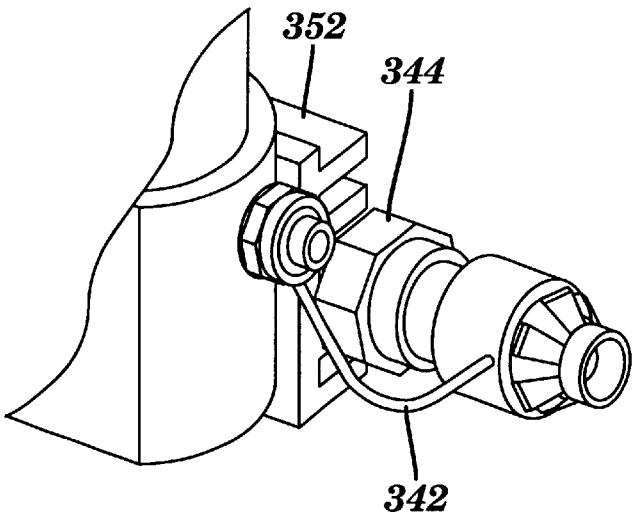
FIG. 10*a* is a view of the reverse flush valve of the preferred embodiment in the locked spray position.

As can be seen in FIGS. 10*a* and 10*b*, the collet 338 is clamped down on the stem 332 and is held secure by the collar 340. The retaining clip 342 is clipped behind the valve's housing 344 to maintain all components in position ensuring that the operator cannot inadvertently push on the valve 330 and open flow.

Figure 11B:
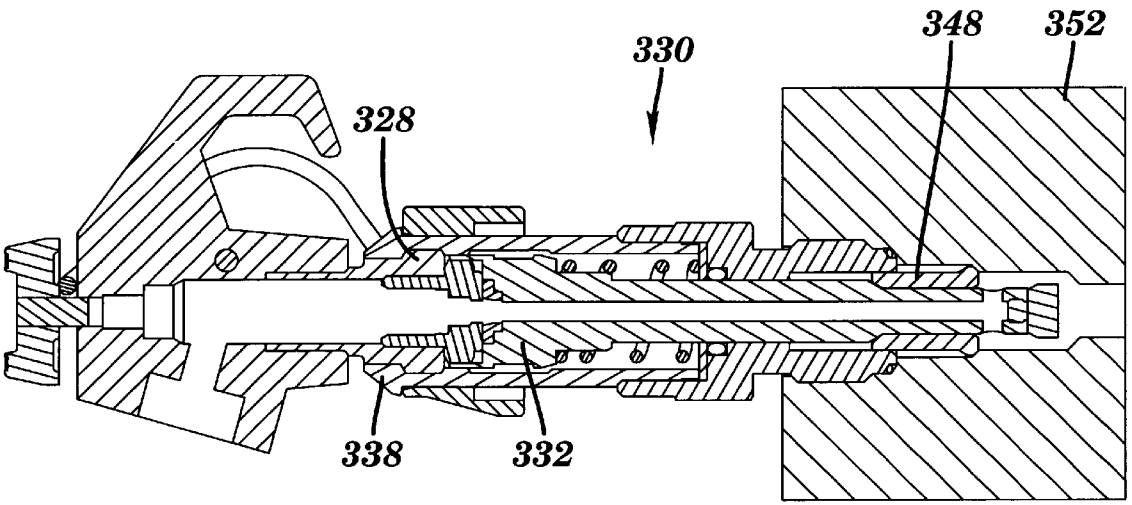
FIG. 11*b* is a cross-sectional view of the reverse flush valve of the preferred embodiment in the clean mode.
Figure 11A:
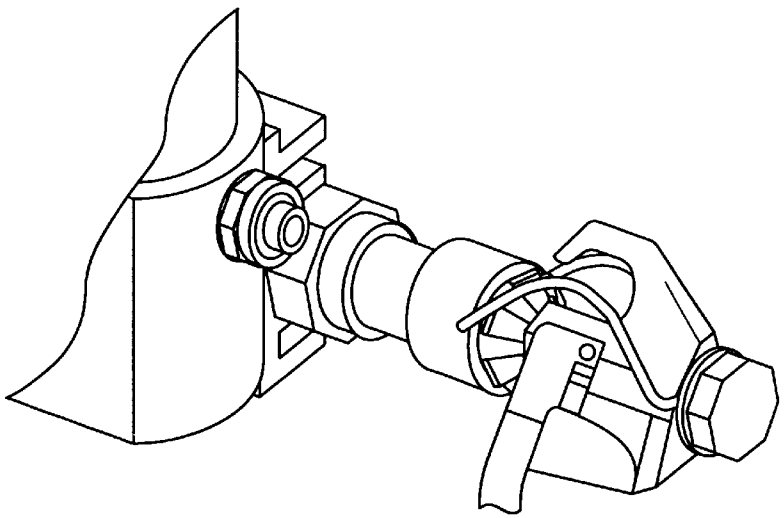
FIG. 11*a* is a view of the reverse flush valve of the preferred embodiment in the clean mode.
Figure 12:
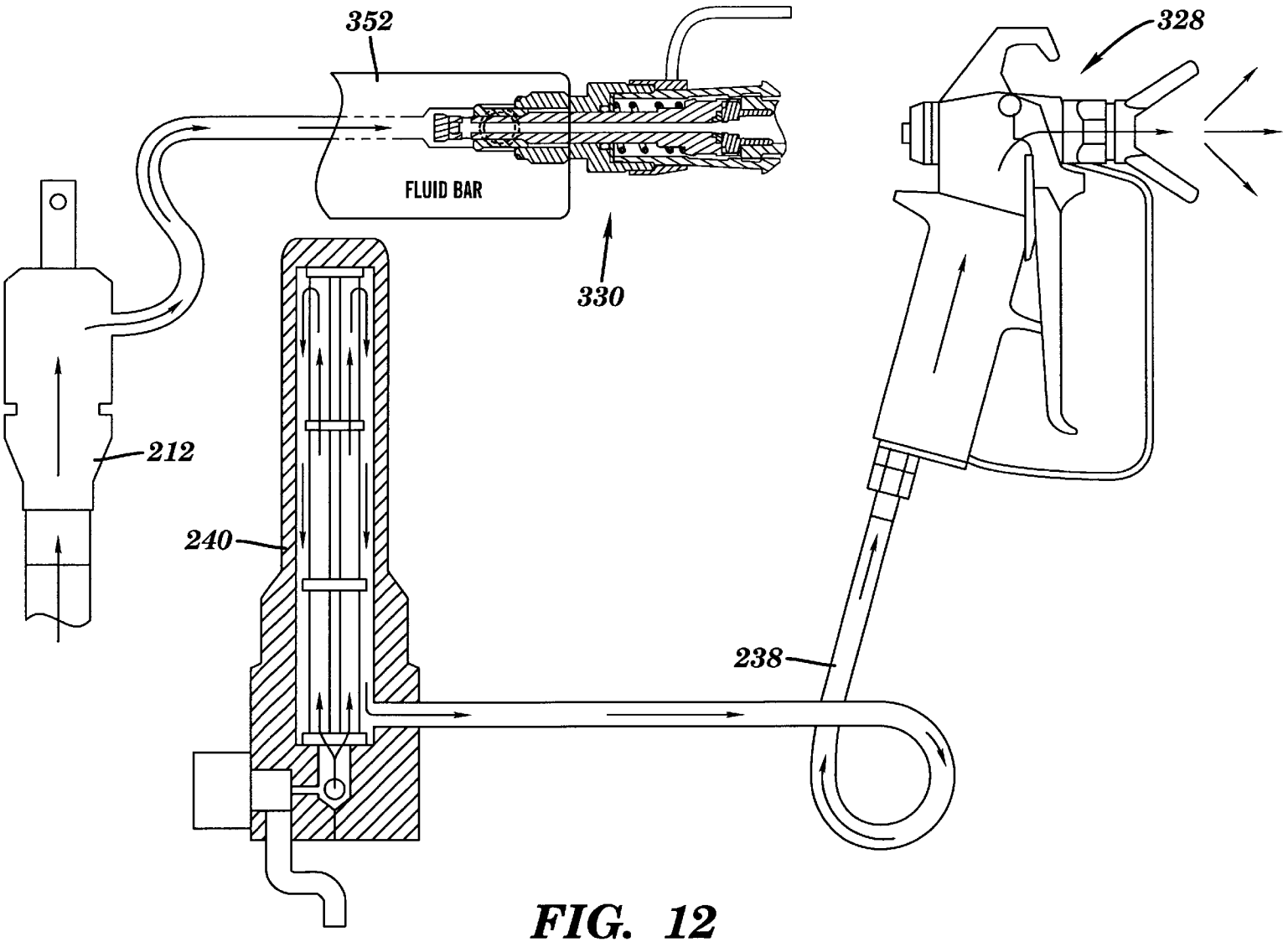
FIG. 12 is a schematic view of the preferred embodiment of the instant invention in the standard spray configuration.
Figure 13:
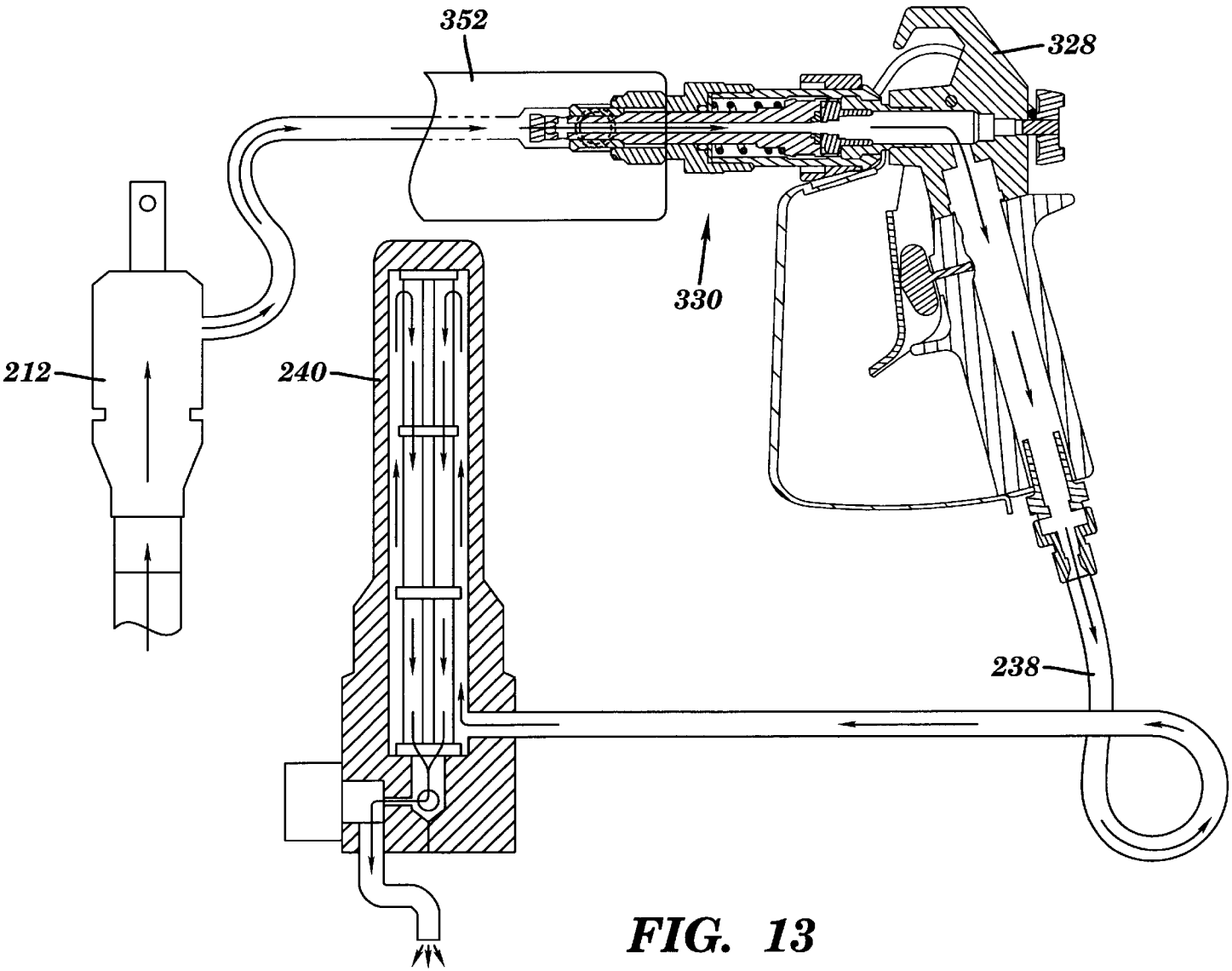
FIG. 13 is a schematic view of the preferred embodiment of the instant invention in the flush configuration.

The cleaning mode can be seen in FIGS. 11*a*, 11*b* and 13. The spray gun 328 is inserted into collet 338 where it is engaged internally by stem 332 and gasket 334. As the valve 330 is actuated, the stem 332 slides into the fluid bar 352 lifting the poppet 350 off the sleeve 348. Once the stem's cross holes 332*a* are exposed from inside the sleeve 348, the stem 332 begins to pull the sleeve 348 farther into the fluid bar 352. The sleeve 348 will bottom out to seal on its outer diameter 348*a* against a mating feature on the fluid bar 352. In this position, the sleeve 348 will seal off flow from entering the filter manifold 326 and redirect the flow into the cross holes 332*a* of the stem 332 and out through the center of the stem 332.

The system may be controlled by a processor for any of the embodiments set forth so that the pump is operated: (1) until the operator sees the output to be clean; or (2) in the preferred embodiment for a predetermined period of time while the operator does other things; or (3) until an opacity detector finds the output to be clear; or (4) until a pressure sensor sees a pressure drop reflecting exhaustion of the cleaning fluid.

It is contemplated that various changes and modifications may be made to the sprayer without departing from the spirit and scope of the invention as defined by the following claims.

What is claimed is:

1. A method for flushing a paint sprayer having a spray gun with an outlet, said spray gun being attached to a pump and a filter, all having a normal direction of fluid flow and comprising the steps of:

supplying a cleaning fluid to said spray gun outlet; and pumping said cleaning fluid from said outlet through said gun and said filter in a direction opposite to said normal direction.

2. The method of claim 1 wherein said spray gun outlet is immersed in a container of cleaning fluid.

3. The method of claim 1 wherein said spray gun outlet is connected to an outlet of said pump.

4. A method for flushing a paint sprayer having a spray gun having an inlet and an outlet and being attached to a pump having an inlet and an outlet and a filter having an inlet and an outlet, said spray gun, pump and filter all having a normal direction of fluid flow and comprising the steps of:

supplying said pump inlet with cleaning fluid;

connecting said spray gun outlet to said pump outlet;

connecting said spray gun inlet to said filter outlet; and pumping said cleaning fluid through said gun and said filter in a direction opposite to said normal direction.

5. The method of claim 4 further comprising means for detecting the exhaustion of said cleaning fluid.

6. The method of claim 4 further comprising means terminating said pumping in said reverse direction after a predetermined period of time.

7. A method for flushing a paint sprayer having a spray gun having an inlet and an outlet and being attached to a pump having an inlet and an outlet and a filter having an inlet and an outlet, said spray gun, pump and filter all having a normal direction of fluid flow and comprising the steps of:

supplying said gun outlet with cleaning fluid;

connecting said spray gun inlet to said filter outlet;

connecting said pump inlet to said filter inlet; and pumping said cleaning fluid through said gun and said filter in a direction opposite to said normal direction.

8. The method of claim 7 further comprising means for detecting the exhaustion of said cleaning fluid.

9. The method of claim 7 further comprising means terminating said pumping in said reverse direction after a predetermined period of time.

* * * * *